US006645926B2

(12) United States Patent
Abriles et al.

(10) Patent No.: US 6,645,926 B2
(45) Date of Patent: Nov. 11, 2003

(54) FLUORIDE CLEANING MASKING SYSTEM

(75) Inventors: Beth Kwiatkowski Abriles, North Branford, CT (US); Bryan W. Manis, Woodstock, CT (US); Murali N. Madhava, Tulsa, OK (US)

(73) Assignee: United Technologies Corporation, Hartford, CT (US)

( * ) Notice: Subject to any disclaimer, the term of this patent is extended or adjusted under 35 U.S.C. 154(b) by 160 days.

(21) Appl. No.: 09/996,533

(22) Filed: Nov. 28, 2001

(65) Prior Publication Data

US 2003/0100474 A1 May 29, 2003

(51) Int. Cl.[7] ..... C11D 7/08

(52) U.S. Cl. ..... 510/257; 510/201; 510/202; 510/245; 510/253; 510/254; 510/257; 134/2; 134/3

(58) Field of Search ..... 510/201, 202, 510/245, 253, 254, 257; 134/2, 3

(56) References Cited

U.S. PATENT DOCUMENTS 4,098,450 A * 7/1978 Keller et al. ..... 228/119
4,889,589 A * 12/1989 McComas ..... 156/646
5,650,041 A * 7/1997 Gotoh et al. ..... 156/653.1
5,685,917 A * 11/1997 Sangeeta ..... 134/2
6,379,749 B2 * 4/2002 Zimmerman, Jr. et al. . 427/307

* cited by examiner

*Primary Examiner*—Charles Boyer
(74) *Attorney, Agent, or Firm*—Bachman & LaPointe, P.C.

(57) ABSTRACT

The present invention relates to a maskant system for use with a fluoride cleaning system. The maskant system comprises a parting compound applied to a surface which requires protection and a chromium rich maskant for substantially preventing intergranular attack and which reduces a depletion zone. The parting compound contains colloidal silica, de-ionized water, fused alumina grains, and alumina powder. The maskant is comprised of chromium powder mixed with a binder, a wetting agent, a thickening agent, and water. The maskant system may be used to clean components formed from nickel-based or cobalt-based alloys using a fluoride cleaning system and has particular utility when components formed from single crystal nickel based alloys are cleaned using a fluoride cleaning system.

13 Claims, No Drawings

FLUORIDE CLEANING MASKING SYSTEM

BACKGROUND OF THE INVENTION

The present invention relates to a maskant system for preventing unwanted hydrogen fluoride gas attack on superalloys used in turbine engine components and to a method for cleaning such components using the maskant system.

Fluoride cleaning systems are used to remove unwanted oxides from surfaces and service induced cracks of turbine engine components, such as turbine blade airfoils, formed from nickel base superalloys prior to repairing the components. Hydrogen fluoride gas used in the cleaning treatment both depletes and intergranularly attacks the component surfaces and the exposed cracks, removing essential elements that form gamma prime nickel particles, leaving for some specific applications an undesirable gamma layer on the surface and along the cracks. This depletion layer on the base superalloy is typically between 0.0004 and 0.0009 inches. Presently acceptable levels of intergranular attack can be as high as 0.012 inches in some alloys and some types of turbine airfoils.

Those components that can tolerate depletion and intergranular attack from the fluoride cleaning can be repaired and returned to service. There are other components, due to their intended operating conditions, e.g. stress and temperature, in order to be subjected to a repair that requires fluoride cleaning, require minimal depletion and intergranular attack. A suitable maskant is needed to protect these components as well as some areas of the components during fluoride cleaning treatments.

SUMMARY OF THE INVENTION

Accordingly, it is an object of the present invention to provide a maskant system which minimizes depletion and which substantially eliminates intergranular attack.

It is a further object of the present invention to provide a maskant system as above which increases the number of repair cycles beyond current levels.

It is yet a further object of the present invention to provide a maskant system as above which provides structural integrity improvement by not having hydrogen fluoride gas attack in critical areas.

The foregoing objects are attained by the maskant system and the method of the present invention.

In accordance with the present invention, a maskant system for use in a fluoride cleaning system is provided. The maskant system broadly comprises a plurality of layers of a parting compound applied to a component surface which requires protection and a plurality of layers of chromium rich maskant applied over the parting compound layers for substantially preventing intergranular attack and for reducing any depletion zone. The parting compound comprises a mixture containing colloidal silica, de-ionized water, fused alumina grains, and alumina powders such as 100 mesh alumina powder, 325 mesh alumina powder, and/or calcined and low soda alumina powder. The maskant is comprised of a chromium powder mixed with a binder, a wetting agent, a thickening agent, and water. The maskant system of the present invention has particular utility in the cleaning of turbine airfoils formed from nickel-based alloys or cobalt-based alloys.

In accordance with the present invention, a method for cleaning a turbine airfoil broadly comprises the steps of applying from 2 to 6 layers of a parting compound to a surface which requires protection, applying from 2 to 6 layers of a maskant over the layers of parting compound, and subjecting the surface to a hydrogen fluoride cleaning treatment.

Other details of the fluoride cleaning masking system and the cleaning method of the present invention, as well as other objects and advantages attendant thereto, are set forth in the following detailed description.

DETAILED DESCRIPTION OF THE PREFERRED EMBODIMENT(S)

As previously discussed, the present invention is directed to a maskant system to be used in cleaning surfaces of turbine engine components, such as airfoil surfaces, formed from a nickel base or a cobalt base superalloy, preferably a single crystal nickel base superalloy. The maskant system comprises a parting compound and a chromium rich maskant applied over the parting compound. The parting compound enables easy removal of the maskant after the fluoride cleaning treatment. The chromium rich maskant adequately prevents intergranular attack and reduces the depleted zone.

The parting compound comprises a mixture containing colloidal silica, de-ionized water, fused alumina grains, and alumina powder. The alumina powder used in the parting compound includes at least one of 100 mesh alumina powder, 325 mesh alumina powder, and calcined and low soda alumina powder. A useful parting compound composition consists essentially of from 25.75 to 27.75 vol % colloidal silica, from 1.25 to 3.25 vol % deionized water, from 5.75 to 7.75 vol % fused alumina grains, from 51.75 to 53.75 vol % 325 mesh alumina powder, from 4.5 to 6.5 vol % 100 mesh alumina powder, and 5 to 7 vol % calcined and low soda powder.

The parting compound is applied to the surface(s) to be cleaned, particularly in critical areas, in layers. Typically, from 2 to 6 layers of the parting compound are applied to the surface to be cleaned. Each layer of parting compound may be applied using any suitable technique in the art including, but not limited to, dipping, spraying, painting, or pouring the parting compound into a box around the component whose surface(s) is to be protected.

The maskant which is applied over the layers of parting compound comprises a mixture of chromium powder mixed with a binder, a wetting agent, a thickening agent, and water. The chromium powder used in the maskant preferably comprises −325 mesh size chromium powder. The wetting agent may be acetone or an alcohol. The thickening agent comprises a methycellulose such as carboxy methylcellulose. The binder comprises a stop-off compound made up of rare earth elements. Commercially available stop-off compounds which can be used to form the maskant include Nicrobraz white stop off manufactured by Wall Colmonony, Wesgo Stoypt manufactured by Morgan Advanced Ceramics, Wesgo Metals Division, and Vitta 1AL manufactured by Vitta Corporation. A useful maskant material which can be used in the present invention comprises a mixture consisting essentially of from 17.5 to 18.5 vol % water, 0.15 to 0.31 vol % carboxy methyl cellulose, 1.8 to 2.3 vol % acetone, 18 to 22 vol % stop-off compound, and the balance essentially −325 mesh chromium powder.

The maskant is applied over the layers of parting compound. Typically, 2 to 6 layers of maskant will be applied over the parting compound layers. Each layer of maskant may be applied using any suitable technique known in the art including, but not limited to, dipping, spraying, painting, or pouring into a box around the component whose surface(s) is being protected.

After the maskant has been applied, the surface(s) to be cleaned may be subjected to a fluoride cleaning treatment which uses hydrogen fluoride gas. The fluoride cleaning treatment may be any suitable fluoride cleaning treatment known in the art.

It has been found that by using the maskant, components formed from single crystal nickel base superalloys, may be cleaned using a fluoride cleaning treatment which uses hydrogen fluoride gas without any observable intergranular attack and a depletion layer of less than 0.0002 inches. The same single crystal nickel base superalloys, when not provided with the maskant system of the present invention and when subjected to a fluoride cleaning treatment using hydrogen fluoride gas, exhibit a general depletion layer of 0.0004 to 0.0012 inches, a localized depletion layer of 0.004 to 0.009 inches, and a maximum intergranular attack in the range of 0.004 to 0.008 inches, for the cases in which intergranular and/or interdendritic boundaries are encountered.

By using the maskant system of the present invention, components, such as vanes and blades used in gas turbine engines, have improved structural integrity because hydrogen fluoride gas does not attack critical areas, the reduction in the depleted zone, and the elimination of intergranular attack. Another advantage to using the maskant system of the present invention is an increase in the number of repair cycles.

It is apparent that there has been provided a fluoride cleaning maskant system which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A maskant system for use with a fluoride cleaning treatment which comprises:

a plurality of layers of a parting compound applied to a component surface which requires protection; and a chromium rich maskant applied over said parting compound layers.

2. A maskant system according to claim 1, further comprising each layer of said parting compound being formed by a parting compound containing colloidal silica, de-ionized water, fused alumina grains, and alumina powder.

3. A maskant system according to claim 2, wherein said alumina powder includes at least one of 100 mesh alumina powder, 325 mesh alumina powder, and calcined and low soda alumina powder.

4. A maskant system according to claim 2, wherein said alumina powder includes 100 mesh alumina powder, 325 mesh alumina powder, and calcined and low soda alumina powder.

5. A maskant system according to claim 2, wherein said parting compound used in each said parting compound layer consists essentially of from 25.75 to 27.75 vol % colloidal silica, from 1.25 to 3.25 vol % de-ionized water, from 5.75 to 7.75 vol % fused alumina grains, from 51.75 to 53.75 vol % 325 mesh alumina powder, from 4.5 to 6.5 vol % 100 mesh alumina powder, and 5 to 7 vol % calcined and low soda alumina powder.

6. A maskant system according to claim 1, wherein said chromium rich maskant comprises chromium powder mixed with a binder, a wetting agent, a thickening agent, and water.

7. A maskant system according to claim 6, wherein said chromium powder comprises −325 mesh size chromium powder, said wetting agent comprises at least one of alcohol and acetone, said thickening agent comprises methycellulose, and said binder comprises a stop-off compound.

8. A maskant system according to claim 6, wherein said chromium rich maskant comprises from 17.5 to 18.5 vol % water, 0.15 to 0.31 vol % carboxy methyl cellulose, 1.8 to 2.3 vol % acetone, 18 to 22 vol % stop-off compound, and the balance essentially −325 mesh chromium powder.

9. A method for cleaning a component formed from a nickel base or cobalt base alloy comprising the steps of:

applying a parting compound to at least one surface of the component;

applying a chromium rich maskant over the parting compound; and subjecting said component to a fluoride cleaning treatment.

10. A method according to claim 9, wherein said parting compound applying step comprises applying 2 to 6 layers of a parting compound containing colloidal silica, de-ionized water, fused alumina grains, and alumina powder to said at least one surface.

11. A method according to claim 10, wherein said chromium rich maskant applying step comprises applying 2 to 6 layers of a maskant comprising a chromium powder mixed with a binder, a wetting agent, a thickening agent, and water.

12. A method according to claim 9, wherein said parting compound applying step comprises applying 2 to 6 layers of a parting compound consisting essentially of from 25.75 to 27.75 vol % colloidal silica, from 1.25 to 3.25 vol % de-ionized water, from 5.75 to 7.75 vol % fused alumina grains, from 51.75 to 53.75 vol % 325 mesh alumina powder, from 4.5 to 6.5 vol % 100 mesh alumina powder, and 5 to 7 vol % calcined and low soda alumina powder.

13. A method according to claim 12, wherein said chromium rich maskant applying step comprises applying from 2 to 6 layers of a chromium rich maskant consisting essentially of from 17.5 to 18.5 vol % water, 0.15 to 0.31 vol % carboxy methylcellulose, 1.8 to 2.3 vol % acetone, 18 to 22 vol % stop-off compound, and the balance essentially −325 mesh chromium powder.

* * * * *